United States Patent [19]

Scoggins

[11] 4,406,395

[45] Sep. 27, 1983

[54] ASH RECEPTACLE

[75] Inventor: Tommy D. Scoggins, Graham, N.C.

[73] Assignee: Scoggins Mfg., Inc., Graham, N.C.

[21] Appl. No.: 359,564

[22] Filed: Mar. 18, 1982

[51] Int. Cl.[3] ..... B65D 91/00

[52] U.S. Cl. ..... 232/43.1; 220/1 T; 220/2

[58] Field of Search ..... 232/43.1, 43.2, 43.3, 232/43.4, 43.5; 220/1 T, 2

[56] References Cited

U.S. PATENT DOCUMENTS

| | | | |
|---|---|---|---|
| 232,361 | 9/1880 | Neville | 232/43.1 |
| 260,364 | 7/1882 | Brown . | |
| 918,295 | 4/1909 | Doane . | |
| 1,044,306 | 11/1912 | Vertner | 220/254 |
| 1,161,089 | 11/1915 | Waldo, Jr. | 220/315 |
| 1,470,205 | 10/1923 | Vogt | 220/2 |
| 2,319,725 | 5/1943 | Drinkwater | 232/43.1 |
| 4,275,830 | 6/1981 | McDonald | 232/43.1 |
| 4,363,417 | 12/1982 | Rhoades et al. | 220/1 T |

*Primary Examiner*—Robert A. Hafer

[57] ABSTRACT

The invention presented herein consists of an ash receptacle having an internal storage chamber for holding fireplace ashes or the like. A first hingeable door is provided through which ashes can be deposited and a second door is available through which the ashes are removed. An internal baffle is positioned within the housing to prevent dust from escaping through the first door as ashes are being deposited and a slanted rear wall allows the ashes to slide towards the storage chamber.

10 Claims, 3 Drawing Figures

ASH RECEPTACLE

BACKGROUND AND OBJECTIVES OF THE INVENTION

In recent years, due to the high cost of modern energy production more and more homeowners have turned or returned to the use of wood stoves and fireplaces for cooking and heating purposes. Modern homes are now being constructed and remodeled to include various types of wood burning devices which require periodic cleaning and ash removal. Housewives and others who must spend time removing and transporting ashes to a disposal area require a receptacle which is fireproof, relatively light in weight and which is easy to empty.

In the past various ash cans have been designed with covers having various types of closures in an effort to provide easy access for filling and which prevent dust and ashes from escaping during filling and emptying.

Varying degrees of success have been reached with prior devices and the present invention was developed in an effort to overcome certain problems encountered and not completely solved by prior inventions for handling ashes.

Another objective of the present invention is to provide an ash receptacle which is relatively light in weight and which is easy to carry.

Yet another objective is to provide a practical and attractive ash receptacle prior to and following the removal of ashes from a fireplace or stove which will fit the surrounding decor.

It is another objective of the present invention to provide an ash receptacle which is fireproof and which includes a baffle to prevent ashes from escaping during the filling process.

Other objectives and advantages of the invention will become obvious to those skilled in the art with the more detailed explanations presented below.

DESCRIPTION OF THE PREFERRED EMBODIMENT

The invention in its preferred form comprises a housing of lightweight metal such as a thin gauge galvanized steel and includes an inlet means through which ashes can be deposited therein. The inlet means is provided with a hingeable door and immediately below the inlet means is a baffle member which prevents the light ashes from escaping as they are being deposited in the receptacle. Also, the door of the inlet means is gravity operated and positioned so it will tightly close and help prevent dust or ashes from exiting. Opposite the baffle member is a slanted rear wall which guides the deposited ashes towards a forward storage chamber. An outlet means is provided also having a hingeable door means through which the ashes pass when they are emptied from the receptacle. A handle member is attached to the upper part of the housing for carrying the receptacle and a front gripping means is available for use when the ashes contained therein are being dumped.

DESCRIPTION OF THE DRAWINGS

For more detailed description of the invention and its operation, as receptacle 10 is shown in FIG. 1 having a housing 11 constructed of metal which may be, for example, aluminum or galvanized steel. For illustrative purposes shovel 12 is depicted inserting ashes through inlet means 13 with hingeable door means 14 being open. As shown in FIG. 1 hingeable door means 14 opens outwardly but could be modified to open inwardly, if desired.

Figure 1:
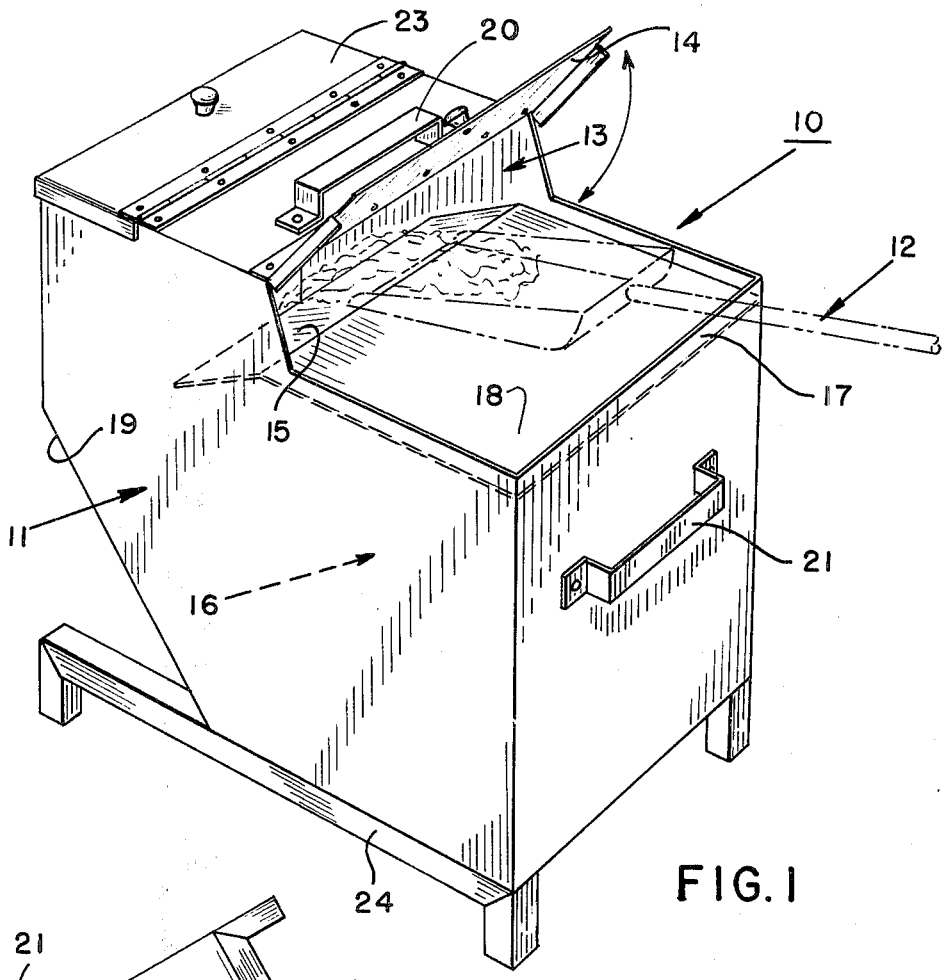
FIG. 1 is a perspective view of the invention demonstrating the filling procedure.

Baffle member 15 is shown positioned below door means 14 and above internal storage chamber 16. Positioned above internal storage chamber 16 is flange member 17 which is useful in capturing dust which may fall on housing top 18 as ashes are shoveled through inlet means 13.

Figure 2:
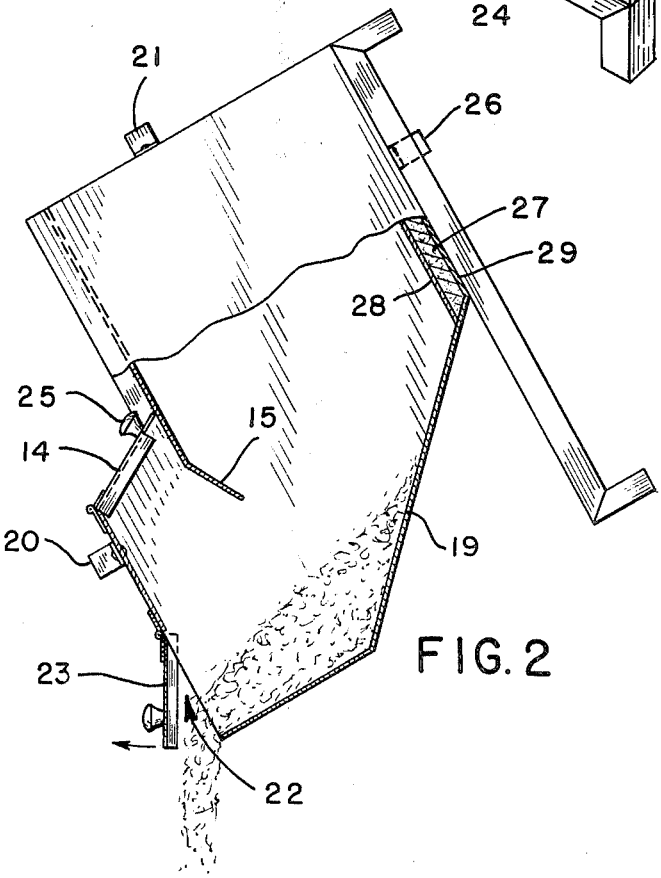
FIG. 2 illustrates the emptying of the ash receptacle of FIG. 1.

As would be understood, ashes that pass over baffle member 15 fall generally downwardly and strike rear housing wall 19 as shown in FIG. 2. Rear housing wall 19 is slanted and acts as a guide for directing the ashes towards internal storage chamber 16. As the ashes slide down rear housing wall 19 they accumulate substantially beyond baffle member 15 within the general confines of internal storage chamber 16. Ash receptacle 10 can be bumped or shaken to further direct the ashes contained therein towards and into chamber 16 and baffle member 15 prevents the lighter ashes from escaping. Thus, when additional ashes are deposited, the ashes already confined are generally not affected by air currents within housing 11 and are prevented from exiting inlet 13.

In use, ash receptacle 10 can be carried to a dump area by handle means 20. Handle means 20 is located so that ash receptacle 10 will tilt upwardly toward outlet means 22 as receptacle 10 is being carried. This upward tilting causes outlet door means 23 to tightly close during transportation to the dump site. By placing one hand on handle means 20 and the other on gripping means 21, ash receptacle 10 can be easily inverted and emptied as shown in FIG. 2. Bottom gripping means 26 is available to assist the user during dumping to insure total emptying and for convenience in handling. During inversion, the ashes present in storage chamber 16 are directed down along rear housing wall 19 and on through outlet means 22. Outlet door means 23 is gravity operated allowing receptacle 10 to be quickly dumped. Receptacle 10 can then be returned to its upright position and carried back to a convenient location near a fireplace or wood stove and is available for future use.

Support means 24, as shown in FIG. 1, allows receptacle 10 to be raised off of the floor to thus reduce the likelihood of floor damage or fire by hot coals which may be inadvertently placed in ash receptacle 10. As shown in FIG. 2 a double floor is provided to insure that an excess amount of heat does not reach the floor underneath ash receptacle 10 and insulation 27 which may be asbestos can be inserted under floor panel 28 or an air space between panel 28 and bottom member 29 may be sufficient under certain circumstances.

Figure 3:
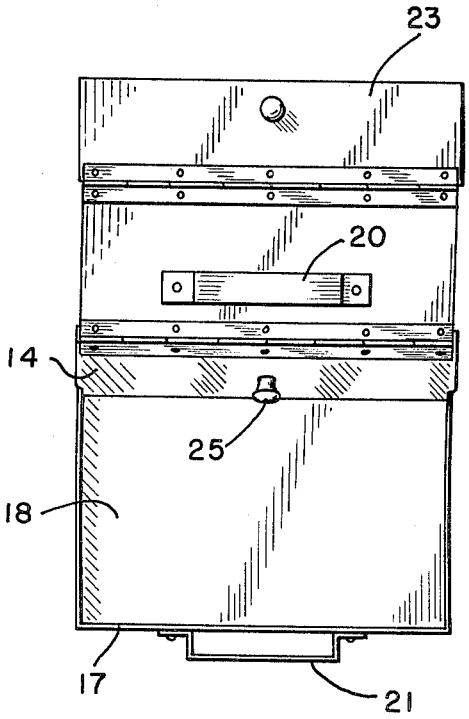
FIG. 3 is a top plan view of the embodiment as shown in FIG. 1.

FIG. 3 illustrates the angular placement of hingeable door means 14 and the top view clearly illustrates knob 25 place thereon. The angular placement of hingeable door means allows for easy opening when inserting ashes and the gravity closing causes a tight fit to further prevent ashes from escaping.

Various modifications can be made to the ash receptacle illustrated herein and the drawings and examples presented are for illustrative purposes and are not intended to limit the scope of the invention.

I claim:

1. An ash receptacle comprising: a housing, said housing having a slanted rear wall member, an inlet means, said inlet means located in said housing, said inlet means opposite said rear wall, an outlet means, said outlet means separate from said inlet means and located in said housing, a baffle member, said baffle member positioned in said housing above said slanted rear wall below said inlet means.

2. An ash receptacle as claimed in claim 1 and including a handle means attached to said housing.

3. An ash receptacle as claimed in claim 1 wherein said housing forms an internal storage chamber.

4. An ash receptacle as claimed in claim 3 wherein said inlet means communicates with said storage chamber.

5. An ash receptacle as claimed in claim 3 wherein said baffle member is positioned above said storage chamber.

6. An ash receptacle as claimed in claim 1 and including support means.

7. An ash receptacle as claimed in claim 1 and including a gripping means.

8. An ash receptacle as claimed in claim 1 wherein said inlet means comprises a hingeable door means.

9. An ash receptacle as claimed in claim 1 wherein said outlet means comprises a hingeable door means.

10. An ash receptacle comprising: a housing, said housing forming a storage chamber, said housing having an inlet means, said inlet means including a hingeable door means, said housing having a slanted rear wall, said inlet means opposite said rear wall, said housing having an outlet means, said outlet means separate from said inlet means and including a hingeable door means, said outlet means being positioned above said slanted rear wall, an external flange member, said flange member joined to said housing above said storage chamber.

* * * * *